United States Patent [19]

Morken

[11] 4,119,134

[45] Oct. 10, 1978

[54] DRAPERY PLEAT HOLDER

[76] Inventor: John Edward Morken, 3301 Freeman, Fort Wayne, Ind. 46804

[21] Appl. No.: 421,402

[22] Filed: Dec. 3, 1973

Related U.S. Application Data

[63] Continuation-in-part of Ser. No. 274,276, Jul. 24, 1972, abandoned.

[51] Int. Cl.[2] ..... A47H 1/00

[52] U.S. Cl. ..... 160/349 R

[58] Field of Search ..... 160/348, 349, 349 D; 24/73 CH

[56] References Cited

U.S. PATENT DOCUMENTS

| | | | |
|---|---|---|---|
| 2,520,653 | 8/1950 | Rand | 160/349 D UX |
| 3,011,174 | 12/1961 | Schaerer | 160/348 UX |
| 3,155,150 | 11/1964 | Silvestre | 160/348 |
| 3,235,926 | 2/1966 | Mates | 24/73 CH |
| 3,255,809 | 6/1966 | Kawczynski | 160/349 |
| 3,338,292 | 8/1967 | Goodman | 160/349 |
| 3,399,713 | 9/1968 | Wilson | 160/348 |

*Primary Examiner*—Philip C. Kannan
*Attorney, Agent, or Firm*—John A. Young

[57] ABSTRACT

A drapery pleat holder consists of a removable, U-shaped, relatively stiff member which is located at the bottom edge of a drapery. Confronting surfaces of the drapery are releasably attached with the fold-producing member, there being a plurality of regularly spaced members at the bottom edge of the drapery. The fold imparted to the drapery at the bottom edge produces a vertical pleat extending from the upper edge to the lower edge. The releasable connection can be in the form of a snap fastener, a fiber connection, or a pressure-sensitive adhesive connection.

5 Claims, 5 Drawing Figures

DRAPERY PLEAT HOLDER

RELATED APPLICATION

This application is a continuation in part of Application Ser. No. 274,276 now abandoned.

BACKGROUND OF THE INVENTION

In the care of draperies, it is required that the draperies be periodically drycleaned and the folds or pleats are thereafter reformed. The process of reshaping the cleaned draperies with pleats, by ironing, is a tedious and time consuming job. To iron into a set of cleaned draperies, a series of regularly spaced, even, pleats takes a considerable degree of skill to accomplish.

What is needed is a releasable, form-producing means which can be readily put into the drapery to impart the necessary shape and form to effect regularly spaced pleats therein.

The shape-imparting means must be readily removable because of the need for periodic cleaning of the draperies, and the shape-imparting means must be by nature an inexpensive and readily manufacturable component.

OBJECTS OF THE INVENTION

It is a principal object of the present invention to provide a simple and inexpensive fold-imparting device for draperies which can be readily attached and detached from the lower edge of the drapery to produce a pleat or fold extending from the bottom edge to the top edge of the drapery.

It is another object of the present invention to provide a relatively stiff fold-producing component for draperies, such component being readily attachable and detachable by various means, as for example a releasable snap fastener, pressure-sensitive means or by a fabric having interlocking or intermeshing fibers.

Other objects and features of the present invention will become apparent from a consideration of the following description which proceeds with reference to the accompanying drawings.

DRAWINGS

Figure 3:
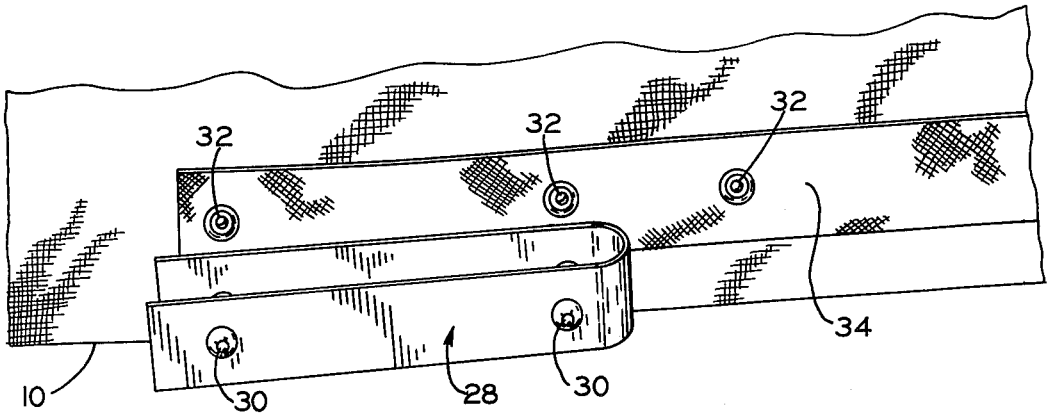
FIG. 3 is an enlarged fragmentary view illustrating a portion of a drapery before it is assembled, with the pleat or fold-producing component illustrated spaced therefrom.
Figure 4:
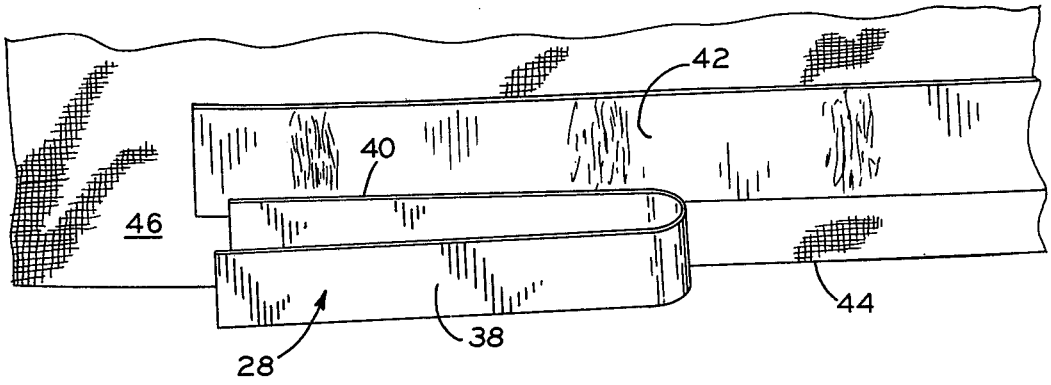
Figure 5:
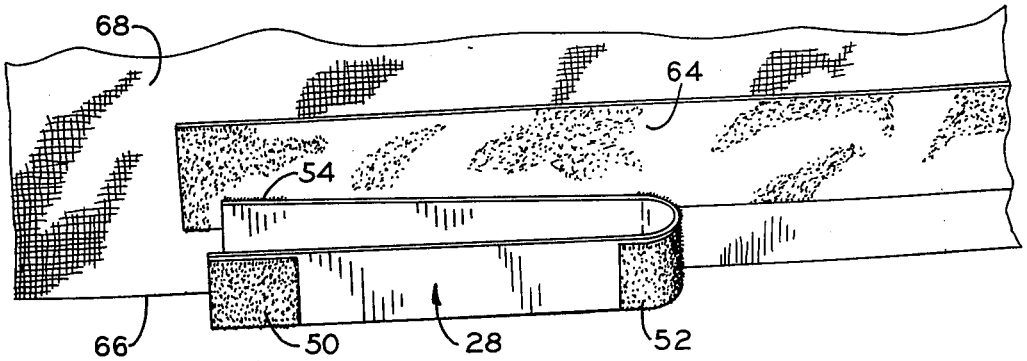

FIG. 4 is the same view as FIG. 3 but illustrating a second embodiment of the invention embodying a further form of coupling the fold-producing element with the bottom edge of the drapery through a pressure-sensitive adhesive at the outer layer of the pleat-producing component; and, FIG. 5 is a still further embodiment of the invention in which the bottom edge of the drapery is attachable to the pleat-producing element through a special fabric having interlocking barb and spike fibers.

DETAILED DESCRIPTION OF THE INVENTION

Figure 1:
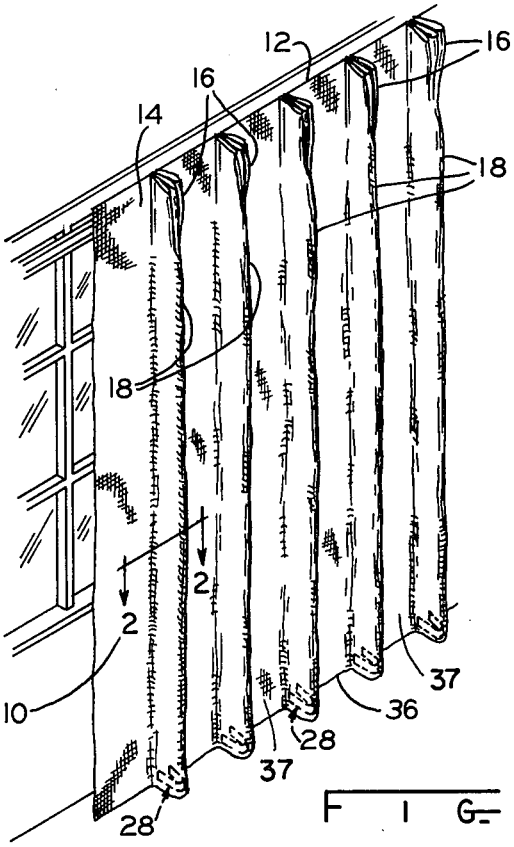
FIG. 1 is an isometric view of a drapery in its extended position and having folds produced in accordance with the present invention and illustrating the pleat-producing elements at the bottom portion of the drapery.
Figure 2:
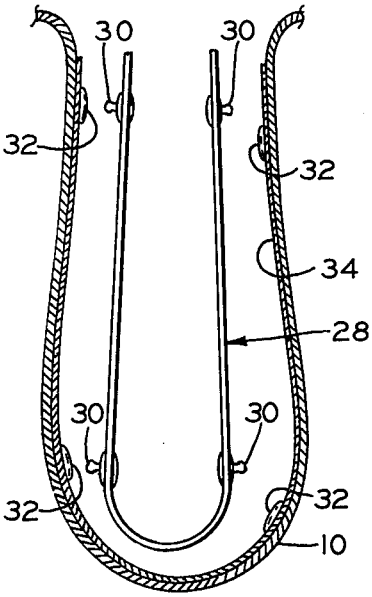
FIG. 2 is a section view taken on line 2—2 of FIG. 1.

A drapery designated generally by reference numeral 10 has at its upper edge 12 a heading 14 consisting of a series of pinched-pleated assemblies 16. Depending from the curtain heading are a number of regularly spaced pleats 18 which are formed by means of relatively stiff U-shaped pleat producing elements 28. The elements 28 are relatively stiff and inexpensive components consisting of plastic and each has a plurality of releasable fasteners consisting of pintles 30 which are received within socket members 32 that are sewed or otherwise attached to the panel 34 on drapery 10. The drapery is folded over element 28 to form a pleat which extends vertically from the lower edge 36 to the upper edge 12. As shown in FIG. 1, the pleats are all of uniform size and are regularly spaced, being joined by drapery portions which are flexible and are all of uniform size since the pleats themselves are regularly spaced apart.

It is relatively easy to form the pleat by simply fitting together the pintle 30 and socket 32 and, by reason of the spacing of the elements 28 it is readily possible to properly locate where the pleat is to be formed in the drapery. When it becomes necessary to dryclean the drapery the elements 28 are easily and quickly removed from the drapery and following cleaning, elements 28 are reinserted at the proper locations thus restoring the pleats through the vertical height of the drapery. The elements are interchangeable so no effort is required to keep them separate or apart during removal and replacement.

As indicated at the lower edge 36, the drapery sections 37 are of uniform size, and are themselves flexible so that when the drape is drawn, the sections 37 fold at the midpoint between the respective pleats thus allowing the pleats to be drawn together as the drape is retracted. Thus, the pleats remain the same size whether the drape is extended or retracted. Sections 37 act as hinges whereby the pleats can be extended farther apart by the width of the sections 37 where the pleats can be brought together by simply folding the sections 37 in half but in either event the pleats once established will hold their size and regular spacing.

Referring next to the embodiment of FIG. 4 it will be seen that it is not necessary to have a mechanical fastening for the element 28; it is also possible to make the pleat connection through a pressure-sensitive adhesion connection. Referring to FIG. 4 there is a pressure-sensitive adhesive which is provided on the surfaces 38 and 40, this pressure-sensitive adhesive then being used to join the outer surface of element 28 with a panel 42 at the lower edge 44 of drapery 46 thus imparting a fold which extends through the vertical height of the drapery.

The element 28 in this last instance is attached and detached by making and breaking the pressure-sensitive adhesive connection to permit removal and cleaning of the drapery and then rehanging and repleating thereof by reattachment of the elements 28.

Considering next the embodiment of FIG. 5 the member 28 has fiber material laminations 50, 52, 54 having a pile which interlocks with the pile of a panel of similar fabric 64 at lower edge 66 of drapery 68. The characteristics of the pile of these fabric panels is such that they will interlock with each other. The pile is "spiked" so that when sections 50, 52, 54 are pressed against section 64 the bristles will interlock and hold the folded drapery section around member 28 producing a pleat which is held in the drapery. The member 28 can be detached from the drapery in a ready manner prior to drapery cleaning. At the same time, the connection effected between sections 50, 52, 54 and 64 once made, produces a very strong and reliable connection which insures the holding of the pleat in proper position and location until 28 is removed.

Obviously, these few examples of detachable connections between removable fold-producing elements 28 and the drapery are illustrations of what can be provided and are described by way of example, and not by way of limitation.

Although only a few selected example embodiments have been chosen to illustrate the invention it will be understood that these are illustrative of the invention and are by no means restrictive thereof. It is reasonably to be expected that those skilled in this art can make numerous revisions and adaptations of the invention and it is intended that such revisions and adaptations will be included within the scope of the following claims as equivalents of the invention.

What I claim is:

1. In combination with a drapery pleat producing element adapted for producing folds throughout the entire vertical dimension of said drapery, the combination which comprises:

(a) a relatively inflexible U-shaped pleat-producing backing of constant shape wherein a plurality of said U-shaped pleat-producing backings are positioned at intervals along the bottom edge of said drapery; and, (b) gripping means formed between the confronting surfaces of said U-shaped pleat-producing backing and said drapery at the bottom edge of said drapery whereby a series of linearly vertical folds are produced continuously from the bottom edge of said drapery to the top edge of said drapery and said series of linearly vertical folds approach towards and separate from each other upon contracting and spreading said drapery respectively.

2. In combination with a drapery pleat-producing element adapted for producing folds throughout the entire vertical dimension of said drapery, the combination in accordance with claim 1 wherein said gripping means is comprised of:

(a) a snap fastener including complementary pressure fitted elements on said confronting surfaces of said U-shaped pleat-producing backing and the interior surface of said drapery whereby said releasable snap fastener provides for attachment and disattachment of said pleat-producing backing from the drapery.

3. In combination with a drapery pleat-producing element adapted for producing folds throughout the entire vertical dimension of said drapery, the combination in accordance with claim 1 wherein said U-shaped pleat-producing backing includes:

(a) a pressure sensitive adhesive on the outer surface of said U-shaped pleat-producing backing.

4. In combination with a drapery pleat-producing element adapted for producing folds throughout the entire vertical dimension of said drapery, the combination in accordance with claim 1 wherein said gripping means is provided by opposed panels of fabric providing spiked fibers which releasably interlock with each other.

5. In combination with a drapery pleat-producing element adapted for producing folds throughout the entire vertical dimension of said drapery, the combination in accordance with claim 1 wherein said releasable gripping means is provided by a plurality of mechanical fastener means.

* * * * *